US005353789A

United States Patent [19]

Schlobohm

[11] Patent Number: 5,353,789

[45] Date of Patent: Oct. 11, 1994

[54] A FLACCID MASK WITH STRAPS AND A SUPPORTING ELEMENT THAT FORCE THE MASK INTO SEALING ENGAGEMENT WITH THE WEARER'S FACE IN RESPONSE TO FORCE EXERTED BY THE STRAPS ON THE SUPPORTING ELEMENT

[75] Inventor: Joachim Schlobohm, Bad Oldesloe, Fed. Rep. of Germany

[73] Assignee: Dragerwerk AG, Lubeck, Fed. Rep. of Germany

[21] Appl. No.: 977,285

[22] Filed: Nov. 16, 1992

[30] Foreign Application Priority Data

Nov. 21, 1991 [DE] Fed. Rep. of Germany .... P4138172

[51] Int. Cl.[5] ..... A62B 18/08; A62B 18/02; A62B 19/00

[52] U.S. Cl. ..... 128/206.24; 128/206.17; 128/206.28

[58] Field of Search ..... 128/205.25, 206.12, 128/206.13, 206.15, 206.16, 206.17, 206.21, 206.27, 207.11, 206.19, 206.23, 206.24, 206.26, 206.28; 2/6.2, 424

[56] References Cited

U.S. PATENT DOCUMENTS

| | | | |
|---|---|---|---|
| 2,823,671 | 2/1958 | Garelick | 128/206.17 |
| 2,845,927 | 8/1958 | Hill | 128/206.17 |
| 3,757,777 | 9/1973 | Kaufman | 128/206.19 |
| 4,454,881 | 6/1984 | Huber et al. | 128/206.19 |
| 4,501,272 | 2/1985 | Shigematsu et al. | 128/206.15 |
| 4,579,113 | 4/1986 | McCreadie et al. | 128/202.13 |
| 4,630,604 | 12/1986 | Montesi | 128/206.15 |
| 5,033,507 | 7/1991 | Pouchot | 128/206.15 |
| 5,062,421 | 11/1991 | Burns et al. | 128/205.27 |
| 5,154,168 | 10/1992 | Schlobohm . | |

FOREIGN PATENT DOCUMENTS 761263 11/1956 United Kingdom .

*Primary Examiner*—Kimberly L. Asher
*Attorney, Agent, or Firm*—McGlew and Tuttle, P.C.

[57] ABSTRACT

A half mask (1) with a connection opening (13) for a filter (12), with a flexible half mask body (2) with a sealing edge (3) and with a solid filter holder (10) surrounding the half mask body. A strap (16) is connected to the filter holder. Wear comfort and tightness of fit are provided by the half mask body (2) having a supporting structure (17, 19, 21), which extends over at least a certain section and which is brought into engagement with the front sides (18, 20, 22) of the filter holder (10) pointing toward the sealing edge (3) by the strap (16), when the half mask (1) has been put on, in such a manner that the sealing edge (3) is supported.

6 Claims, 3 Drawing Sheets

A FLACCID MASK WITH STRAPS AND A SUPPORTING ELEMENT THAT FORCE THE MASK INTO SEALING ENGAGEMENT WITH THE WEARER'S FACE IN RESPONSE TO FORCE EXERTED BY THE STRAPS ON THE SUPPORTING ELEMENT

FIELD OF THE INVENTION

The present invention pertains to a half mask with a connection opening for a filter, with a flexible half mask body with sealing edge, and with a solid filter holder surrounding the half mask body with a strap.

BACKGROUND OF THE INVENTION

A half mask of this type has become known from U.S. Pat. No. 5,154,168 (corresponding to DE-C1 40 17 336). The prior-art half mask has a half mask body with sealing edge, which is inserted into a filter holder. A filter is attached to the filter holder in the mouth area. The filter holder extends from the mouth area to the cheek area of the half mask body and lies freely on the half mask body. Inhalation is via an inhalation valve, and exhalation via an exhalation valve, which is buttoned into the half mask body in the chin area. A strap, with which the half mask can be attached to the head of the user of the apparatus, is fastened in a ring of the filter holder.

Tightness between the mouth space and the environment is determined in the prior-art half mask by the geometry and the rigidity of the sealing edge, the flexibility of the half mask body, and the lateral support of the half mask body by the filter holder. Even though a soft mask body or a soft sealing edge improves wear comfort, it impairs mechanical stability, while high rigidity of the mask body or of the sealing edge is felt as unpleasant during the use of the half mask.

The filter holder that is in contact with the haft mask body in the cheek area brings about only a certain lateral stabilization of the half mask body, while a direct interaction between the filter holder and the sealing edge, which determines the tightness of the half mask, is nonexistent.

A half mask known from British Patent No. GB-PS 761,263 consists of a flexible half mask body, into which a filter holder with a filter is inserted in the mouth area. A wire coil is vulcanized into the mask body in the area of the sealing edge of the half mask body in order to impart a corresponding rigidity to the sealing edge. The wire coil may be approximately adapted to the contours of the mask user's face.

Even though the prior-art half mask has increased rigidity in the area of the sealing edge due to the wire coil, the half mask can be used only by a certain mask user because of the individually bent wire coil. This makes handling difficult in practical use, because, after preparation of the apparatus for use, the individually preformed half masks would have to be distributed individually to the mask users.

SUMMARY AND OBJECT OF THE INVENTION

The primary object of the present invention is to improve a half mask such that it also has a high level of tightness with different facial shapes, along with good wear comfort.

This object is attained by the half mask body having a supporting means, which extends circularly at least over a certain section and which is engaged, when the half mask is put on, with the front sides of the filter holder pointing toward the seating edge by the strap in such a manner that the sealing edge is supported.

The advantage of the present invention is essentially the fact that the half mask body is reinforced in the area of the sealing edge by a supporting means, which extends circularly over at least a certain section on the mask body, is engaged with the front sides of the solid filter holder, when the half mask is put on, by pulling the strap, and the sealing edge or the half mask body can therefore be made of a particularly flexible material, e.g., a flaccid elastomer, because the lateral support is brought about by the filter holder which is in contact with the supporting means. The defined arrangement of a supporting means on the half mask body makes it possible to adapt the rigidity of the sealing edge to the actual area of the half mask body. The rigidity can be influenced, e.g., by changing the distance between the supporting means and the sealing edge, or by a defined geometry of the supporting means in cooperation with the front side of the filter holder. Adhesive layers, by which the sealing edge of the half mask body is additionally fixed in the filter holder, e.g., when the pulling on the strap does not yet exert its full effect when the half mask is being put on, may also advantageously be present between individual supporting means and the corresponding front sides of the filter holder. Special embodiments of the filter holder are a first filter holder for a filter with screw threads and a second filter holder for a respirator filter with round threads. The differences between the two embodiments are related only to the special connection of the actual types of filter. The filters are arranged directly at the connection opening of the filter holder.

The supporting means in the cheek area of the half mask body is advantageously designed as a first step. The said first step may be designed as an oblique, funnel-shaped surface in the transition area between the sealing edge and the half mask body, and the filter holder is designed as a first front side corresponding to this in the area of the first step. When the half mask is placed on the mask user's face with the strap, the sealing edge is supported by the oblique surface of the first step by the first front side of the filter holder being in contact with the first step by pulling the strap.

It is advantageous to design the supporting means in the nose area as a second, circular step, which is designed as a bead and comes into direct contact with a second front side of the filter holder. A bellows-like deformation zone may additionally be arranged in the nose area of the half mask body for adapting the half mask body to the mask user's nose region.

The supporting means in the chin area is advantageously designed as a supporting lip pointing toward the filter holder, which is supported by a third front side of the filter holder. The supporting lip brings about essentially supporting of the half mask body in the chin area in the radial direction.

The filter holder is preferably designed such that it is in contact with the second step in the nose area and surrounds, in one piece, both the cheek area and the chin area of the half mask body. The filter holder thus forms an outer, stabilizing and supporting shell for the flaccid half mask body.

The filter holder is advantageously of an essentially cylindrical design and can therefore be manufactured as a molding at a particularly low cost. The conically extending half mask body therefore has sufficient free space within the filter holder, and its deformation is not hindered by the wall of the filter holder.

The half mask body preferably has an inhalation valve, which can be buttoned into the connection opening of the filter holder. Simple assembly and disassembly of the half mask body without tools is thus possible.

In a second filter holder for a respirator filter with round-thread connection, the buttoned-over valve housing surface of the inhalation valve also serves as a sealing surface of the round thread. A separate sealing ring is thus eliminated, because the round thread of the respirator filter is directly sealed with the valve housing surface of the inhalation valve.

The exhalation valve is preferably arranged in the chin area of the half mask body. Since the exhalation valve is sealed by the cylindrical filter holder in the assembled state, exhalation openings are arranged in the filter holder beneath the exhalation valve. The filter holder also serves as an impact protection for the exhalation valve in this area.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
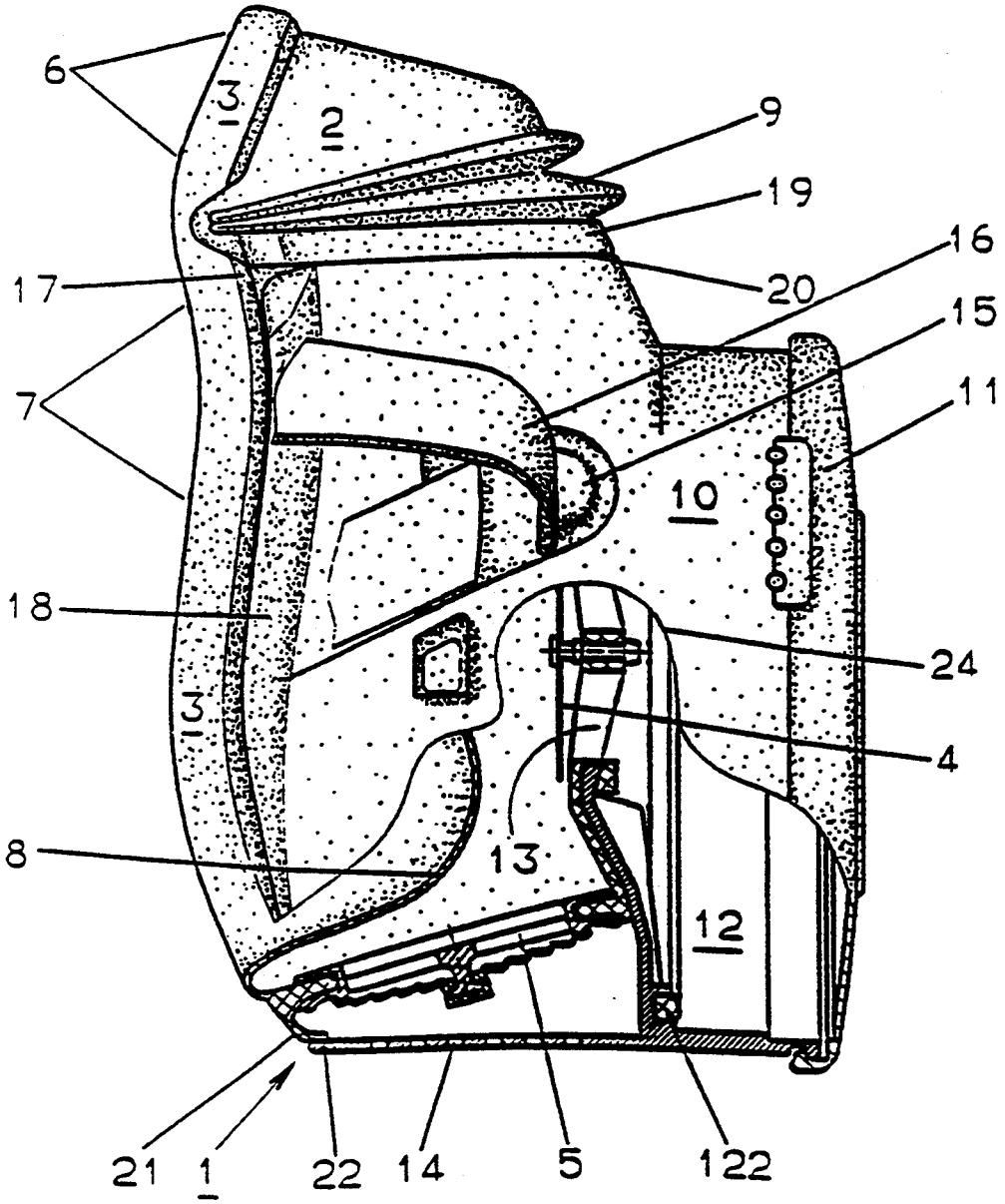
FIG. 1 is a side view of a partially cutaway, first half mask.

The first half mask 1 shown in FIG. 1 consists of a half mask body 2 with a circular sealing edge 3, an inhalation valve 4, and an exhalation valve 5.

The interior of the half mask body 2 can be subdivided into a nose area 6, a cheek area 7, and a chin area 8. A bellows-like deformation zone 9 is arranged in the nose area 6 for better adaptation of the nose area 6 to the contours of the mask user's face. The half mask body 2 is surrounded in a capsule-like manner by a cylindrical first filter holder 10, which is made of a single piece of solid material and in which a filter 12 is fastened with a cover 11. Within the first filter holder 10, the filter 12 is sealed with a sealing ring 122. The first filter holder 10 has a connection opening 13 (also referred to as button connection opening), into which the inhalation valve 4 of the half mask body 2 is buttoned. The half mask 1 is cut open along the section line 24, as a result of which the inhalation valve 4, the exhalation valve 5, and the filter 12 become visible. The filter 12 is designed as a so-called screw-in filter and is rotated against the sealing ring 122 when it is inserted into the first filter holder 10. Inhalation is through the openings (not shown in the Figure) provided in the cover 11, the filter 12, and the inhalation valve 4, while exhalation is via the exhalation valve 5 and the exhalation openings 14 in the first filter holder 10. A strap 16 is attached to a ring 15 of the first filter holder 10. A corresponding ring is located on the opposite side of the first filter holder 10, and is not shown in FIG. 1. With the strap 16, the first filter holder 10 is attached, together with the half mask body 2 and the filter 12, to the face of a mask user, not shown in FIG. 1. Since the filter 12 is attached directly to the first filter holder 10, the force generated by the own weight of the filter 12 is transmitted via the sealing edge 3 to the mask user's face, and no bending moments act on the half mask body 2.

A first step 17 in the form of an oblique, funnel-shaped surface, which is in contact with a correspondingly shaped, first front side 18 of the filter holder, is provided in the half mask body 2 in the cheek area 7 in the transition zone between the sealing edge 3 and the half mask body 2. The oblique surface is produced by the first front side 18 being slightly bent to the outside. A corresponding first step 17 and the first front side 18 are arranged on the opposite side of the half mask 1, but they are not shown in FIG. 1. Due to pulling on the strap 16, the first step 17 lies on the first front side 18 when the half mask 1 has been put on. The step 17 is the supporting means of the half mask body 2 in the cheek area 7. A second step 19, against which a second front side 20 of the first filter holder 10 abuts, is provided as a supporting means in the nose area 6. The supporting means in the chin area 8 of the half mask body 2 is a supporting lip 21, which is in contact with a third front side 22 of the first filter holder 10. The half mask body 2 is made of a flaccid elastomer and is connected to the first filter holder 10 such that the inhalation valve 4 is buttoned into the connection opening 13 of the first filter holder 10. The first step 17 now comes into contact with the first front side 18, the second step 19 with the second front side 20, and the supporting lip 21 with the third front side 22. Due to the interaction between the steps 17, 19 and the supporting lip 21 which together form supporting means extending around a section of the half mask body (extending over a sections of the half mask), and the front sides 18, 20, 22, the sealing edge 3 achieves the necessary stability to lie sealingly on the face of the mask user, not shown in the Figure. A high level of wear comfort is achieved due to the use of a flaccid elastomer for the half mask body 2 and the sealing edge 3.

Figure 2:
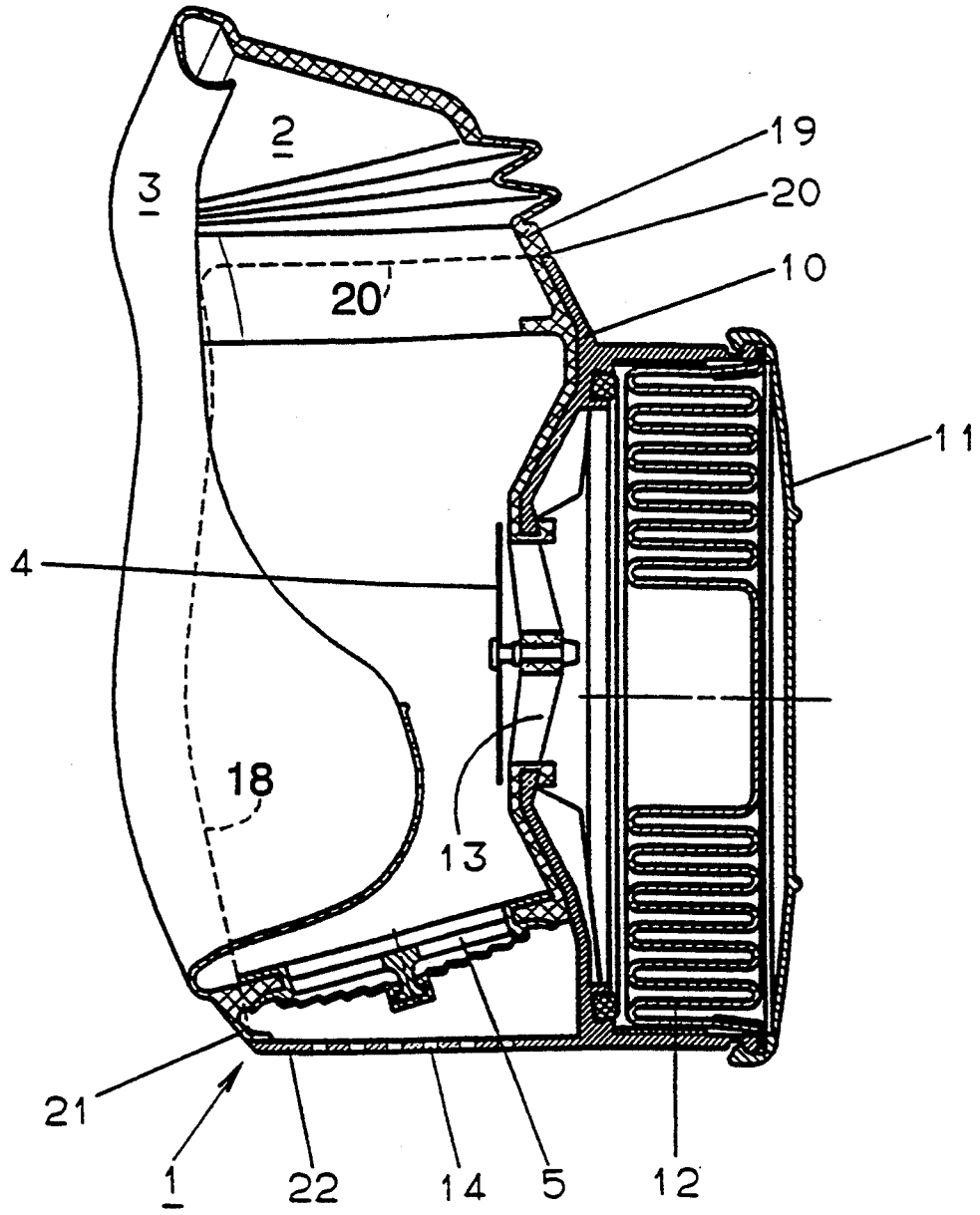
FIG. 2 is a side view of the vertical section of the first half mask.

FIG. 2 shows the vertical section of the half mask 1 according to FIG. 1. Identical components are designated by the same reference numerals as in FIG. 1.

Figure 3:
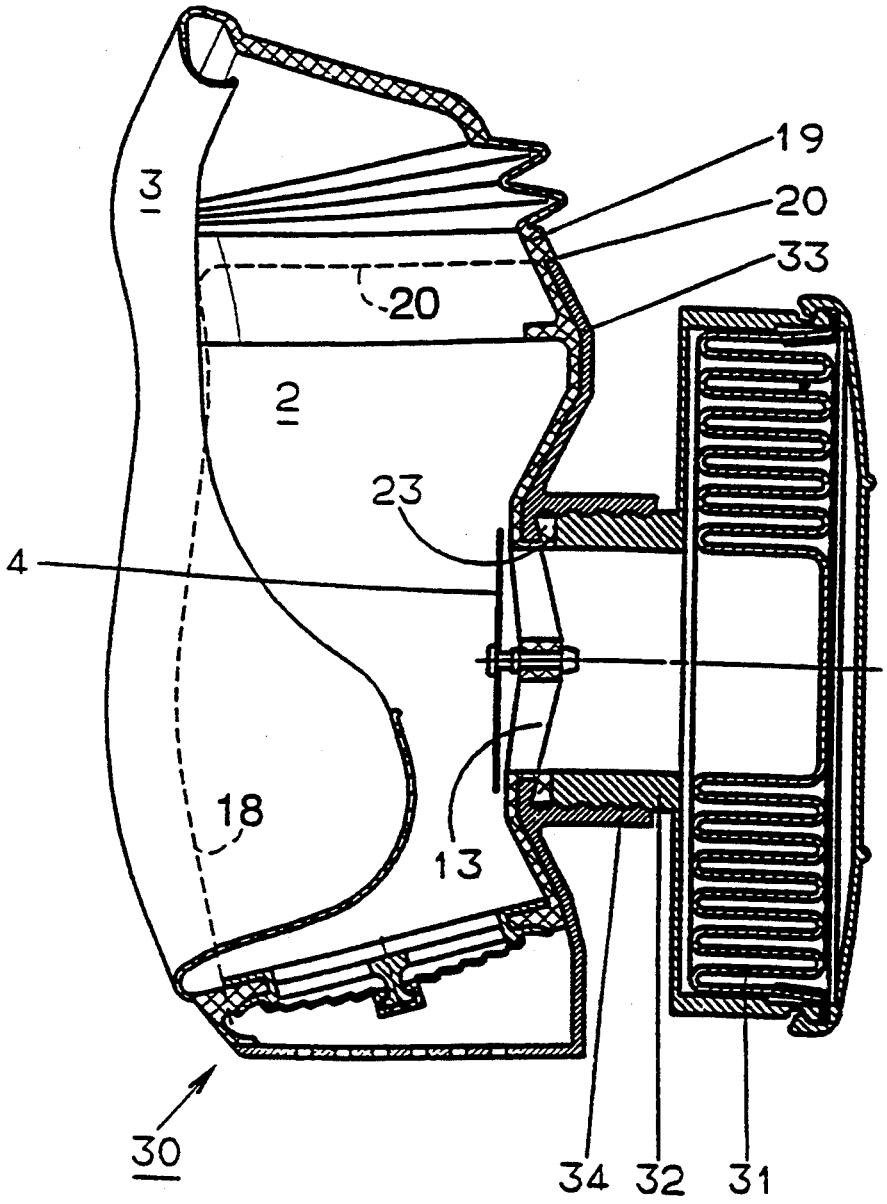
FIG. 3 is a side view of the vertical section of a second half mask for a respirator filter with round-thread connection.

FIG. 3 shows a second half mask 30 with a respirator filter 31 or round-thread connection and a second filter holder 33. Identical components are designated by the same reference numerals as in FIGS. 1 and 2. The round threads 32 are sealed against the second filter holder 33 via the valve housing surface 23 of the inhalation valve 4, which surface 23 is buttoned into the button connection opening 13. Unlike in the filter 12 according to FIGS. 1 and 2, no separate sealing ring 122 is necessary in the second half mask 30. The second filter holder 33 differs from the first filter holder 10 by a threaded pipe 34 being provided for receiving the round threads 32.

While a specific embodiment of the invention has been shown and described in detail to illustrate the application of the principles of the invention, it will be understood that the invention may be embodied otherwise without departing from such principles.

What is claimed is:

1. Half mask, comprising:

a flexible half mask body with a cheek area, and a chin area and a sealing edge for engagement with a face of a user and with a connection opening for a filter;

a solid filter holder including a one piece element surrounding a front portion of said half mask body and surrounding both said cheek area and said chin area, said filter holder having front sides pointing in a direction towards said sealing edge, said half mask body being provided with an inhalation valve including structure which can be buttoned into said filter holder;

a strap connected directly to said solid filter holder; and supporting means extending over a section of said flexible half mask body, said supporting means including first step means extending along said sealing edge in said cheek area, said front side of said solid filter holder including a first front side in contact with said first step means, said first step means for transferring forces exerted by said strap, from said first front side to said sealing edge in said cheek area and for facilitating sealing between said sealing edge in said cheek area and the face of the user, said flexible half mask body further including a nose area, said supporting means including second step means provided along said nose area, said filter holder including a second front side in contact with said second step means, said second step means for transferring forces exerted by said strap from said second front side to said sealing edge in said nose area.

2. Half mask according to claim 1, wherein:

said first step means is an oblique, funnel-shaped surface.

3. Half mask according to claim 1, wherein:

said supporting means including a supporting lip in said chin area, said filter holder including a third front side in contact with said supporting lip.

4. Half mask according to claim 1, wherein:

said filter holder including a button connection opening with a sealing surface for a round thread of a respirator filter.

5. Half mask according to claim 1, wherein:

said filter holder includes an exhalation opening adjacent an exhalation valve provided in said flexible half mask body.

6. Half mask, comprising:

a flexible half mask body formed of a flaccid elastomer with a sealing edge for engagement with a face of a user and with a connection opening for a filter;

a solid filter holder surrounding a front portion of said half mask body, said filter holder having front sides pointing in a direction towards said sealing edge;

a strap engaging said solid filter holder; and supporting means extending around a section of said flexible half mask body, said flexible half mask body including a cheek area, said supporting means including first step means extending along said sealing edge in said cheek area, said front side of said solid filter holder including a first front side with a portion shaped corresponding to said first step means, said first step means for transferring forces exerted by said strap, from said first front side to said sealing edge in said cheek area to facilitate a sealing between said sealing edge in said cheek area and the face of the user, said flexible half mask body further includes a nose area, said supporting means including second step means provided along said nose area, said filter holder including a second front side in contact with said second step means, said second step means for transferring forces exerted by said strap from said second front side to said sealing edge in said nose area.

* * * * *